US012117183B2

(12) United States Patent
Huijsing

(10) Patent No.: US 12,117,183 B2
(45) Date of Patent: Oct. 15, 2024

(54) VEHICLE OVEN HAVING AN IMPROVED HEATING ELEMENT

(71) Applicant: B/E AEROSPACE, INC., Winston Salem, NC (US)

(72) Inventor: Hans Huijsing, Ijsselstein (NL)

(73) Assignee: B/E AEROSPACE, INC., Winston Salem, NC (US)

( * ) Notice: Subject to any disclaimer, the term of this patent is extended or adjusted under 35 U.S.C. 154(b) by 670 days.

(21) Appl. No.: 17/163,103

(22) Filed: Jan. 29, 2021

(65) Prior Publication Data

US 2022/0243921 A1 Aug. 4, 2022

(51) Int. Cl.

| | |
|---|---|
| ***F24C 7/06*** | (2006.01) |
| ***F24C 15/30*** | (2006.01) |
| ***F24C 15/32*** | (2006.01) |

(52) U.S. Cl.

CPC ..... *F24C 7/06* (2013.01); *F24C 15/30* (2013.01); *F24C 15/325* (2013.01)

(58) Field of Classification Search

CPC .. F24C 7/06; F24C 7/067; F24C 15/30; F24C 15/325; F24C 15/322; F24C 15/16; F24C 15/327; F24C 7/00; F24C 7/043; H05B 3/283; H05B 3/03; H05B 3/265; H05B 1/0233; H05B 2203/002; H05B 2203/005; H05B 2203/013; H05B 2203/017; H05B 3/12; H05B 3/143; H05B 1/0266; H05B 2203/004; H05B 2203/014; H05B 2203/016; H05B 2203/018; H05B 3/20; H05B 3/42; H05B 3/50; H05B 3/688; H05B 3/748

USPC ..... 219/400, 401

See application file for complete search history.

(56) References Cited

U.S. PATENT DOCUMENTS

| | | | | |
|---|---|---|---|---|
| 1,050,105 | A | 1/1913 | Copeman | |
| 4,430,541 | A * | 2/1984 | Day, Jr. | F24C 15/322 219/400 |
| 5,204,503 | A * | 4/1993 | Maiellano, Jr. | H05B 6/766 219/400 |
| 8,635,995 | B2 * | 1/2014 | Kuhne | F24C 15/322 219/400 |
| 11,439,137 | B2 * | 9/2022 | Jackson | A61L 2/06 |

(Continued)

FOREIGN PATENT DOCUMENTS

| | | |
|---|---|---|
| DE | 102004033372 A1 | 2/2006 |
| DE | 60206122 T2 | 6/2006 |

(Continued)

OTHER PUBLICATIONS

Melanie Fincher, What Is a Convection Oven and When Do You Use It?, Dec. 16, 2020, allrecipes, <https://www.allrecipes.com/article/what-is-a-convection-oven/> (Year: 2020).*

(Continued)

*Primary Examiner* — Chris Q Liu

(74) *Attorney, Agent, or Firm* — SNELL & WILMER L.L.P.

(57) ABSTRACT

An oven heating element assembly includes a heating element operable to heat air that flows across the heating element, wherein the heating element includes, a disk having a metallic layer, a ceramic layer sandwiched between the metallic layer and a second metallic layer, and a fan operable to cause air to flow across the heating element.

13 Claims, 4 Drawing Sheets

(56) References Cited

U.S. PATENT DOCUMENTS

| | | | | |
|---|---|---|---|---|
| 11,602,016 | B2 * | 3/2023 | Song | H05B 3/748 |
| 2010/0193507 | A1 | 8/2010 | Zimmer et al. | |
| 2012/0267149 | A1 * | 10/2012 | Oi | C04B 35/645 29/846 |
| 2013/0156906 | A1 | 6/2013 | Raghavan et al. | |
| 2017/0295612 | A1 * | 10/2017 | Smith | H05B 3/283 |
| 2019/0148204 | A1 | 5/2019 | Yamaguchi et al. | |
| 2020/0288725 | A1 * | 9/2020 | ten Dam | B64D 11/04 |
| 2020/0340102 | A1 * | 10/2020 | Kimura | C23C 16/46 |

FOREIGN PATENT DOCUMENTS

| | | | | |
|---|---|---|---|---|
| DE | 60023995 | T2 | 8/2006 | |
| EP | 0755170 | A2 * | 1/1997 | H05B 1/0266 |
| WO | WO-2004089039 | A1 * | 10/2004 | H01L 21/67109 |

OTHER PUBLICATIONS

Partial European Search Report for European Patent Application No. EP22154039.6, dated Jun. 21, 2022.
Extended European Search Report for European Patent Application No. EP22154039.6, dated Sep. 26, 2022.

* cited by examiner

VEHICLE OVEN HAVING AN IMPROVED HEATING ELEMENT

BACKGROUND

Technological Field

Embodiments relate to an oven for heating food. More specifically, embodiments relate to a vehicle oven having an improved heating element.

Description of Related Art

Conventional ovens for use in vehicles, such as aircraft, typically use a heating element consisting of a plurality of tubes, each tube connected between two power phases and with a resistive element inside. The tubes have large diameters, lengths, and radii, making complex shapes difficult to create. The production process involves a lot of manual labor, making the elements relatively expensive, and the tubes need to be placed next to each other in the airflow, so the assembly has a relatively large thickness. The current designs have drawbacks such as air turbulence and thus contributing to the noise of the oven. The tubes typically result in a large cold area, also referred to as a run out, which affects even throughout the oven. Although such ovens and components have generally been considered satisfactory for their intended purpose, there is still a need in the art for improved ovens and heating elements. The present disclosure provides a solution for this need.

SUMMARY OF THE INVENTION

An oven heating element assembly including a heating element operable to heat air that flows across the heating element, wherein the heating element includes a disk having a metallic layer, a ceramic layer sandwiched between the metallic layer and a second metallic layer, and a fan operable to cause air to flow across the heating element. The fan can be configured to pull air from an oven cavity and push it over the heating element.

The ceramic layer can include at least three distinct individual sections. Each of the at least three distinct individual sections can be disconnected from each other. At least three distinct individual sections can cover each of the 360 degrees of the disk. The at least three distinct individual sections can partially overlap each other. At least one of the metallic layers can include a plurality of fin, pins, ribs, or projections radiating therefrom. The fin can radiates in a direction orthogonal to a plane defined by a primary surface of the at least one of the metallic layers.

The assembly can include at least one attachment point for attaching the disk to an inner portion of the oven. The attachment point can include at least one aerodynamic feature, to reduce the impact on the airflow. The aerodynamic feature can includes at least one rounded edge. The rounded edge can face gravitationally down. The attachments points can also be used to supply the power through.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1:
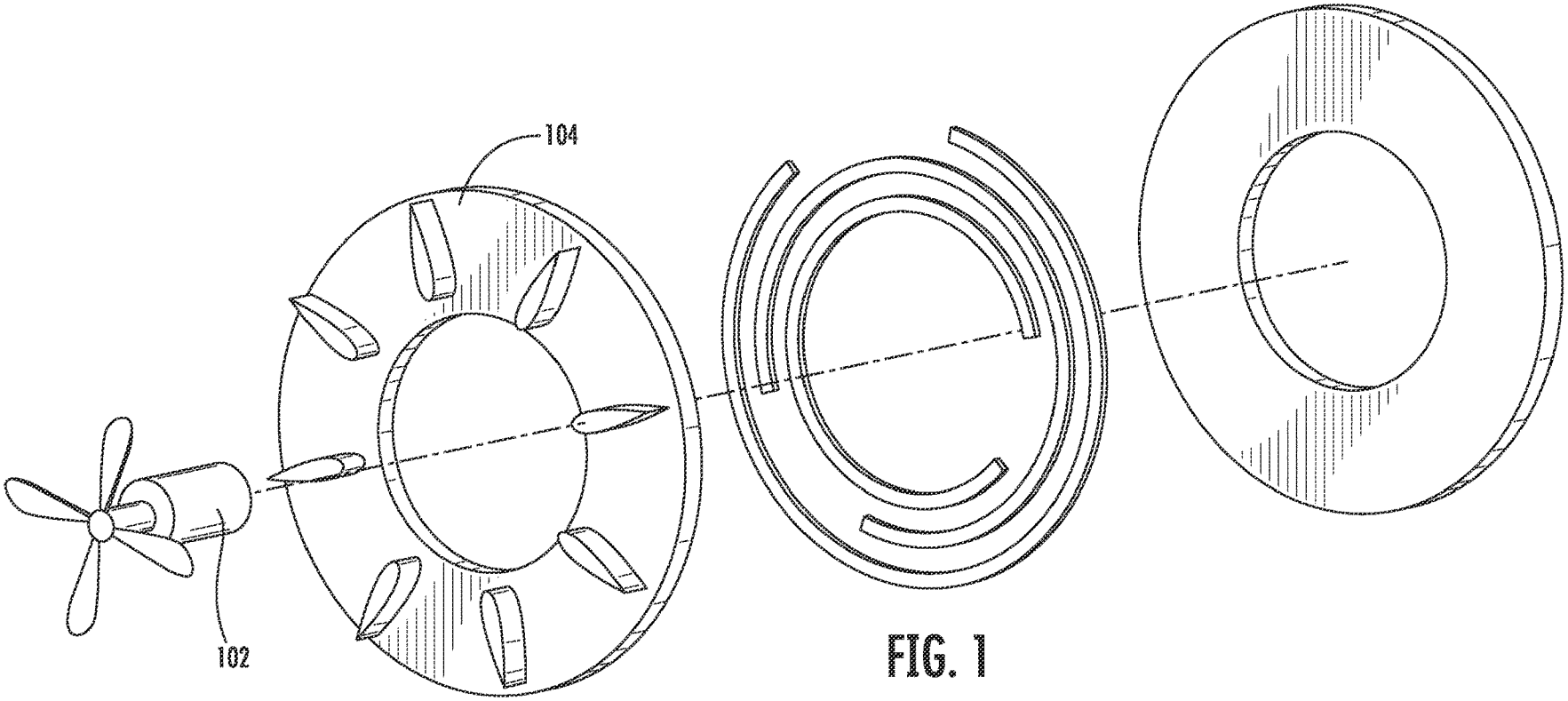
FIG. 1 is a perspective view of an inner portion of the oven showing the fan and heating element.

Reference will now be made to the drawings wherein like reference numerals identify similar structural features or aspects of the subject disclosure. For purposes of explanation and illustration, and not limitation, a partial view of an exemplary embodiment of an oven heating element in accordance with the disclosure is shown in FIG. 1 and is designated generally by reference character 104. Other embodiments of the heating element and portions thereof in accordance with the disclosure, or aspects thereof, are provided in FIGS. 2-5, as will be described. The heating element described herein described herein assures that the ceramic elements are encapsulated and protected, it is much more compact than previous designs and also allows for improving the airflow, reducing noise and increasing air contact surface.

Figure 2:
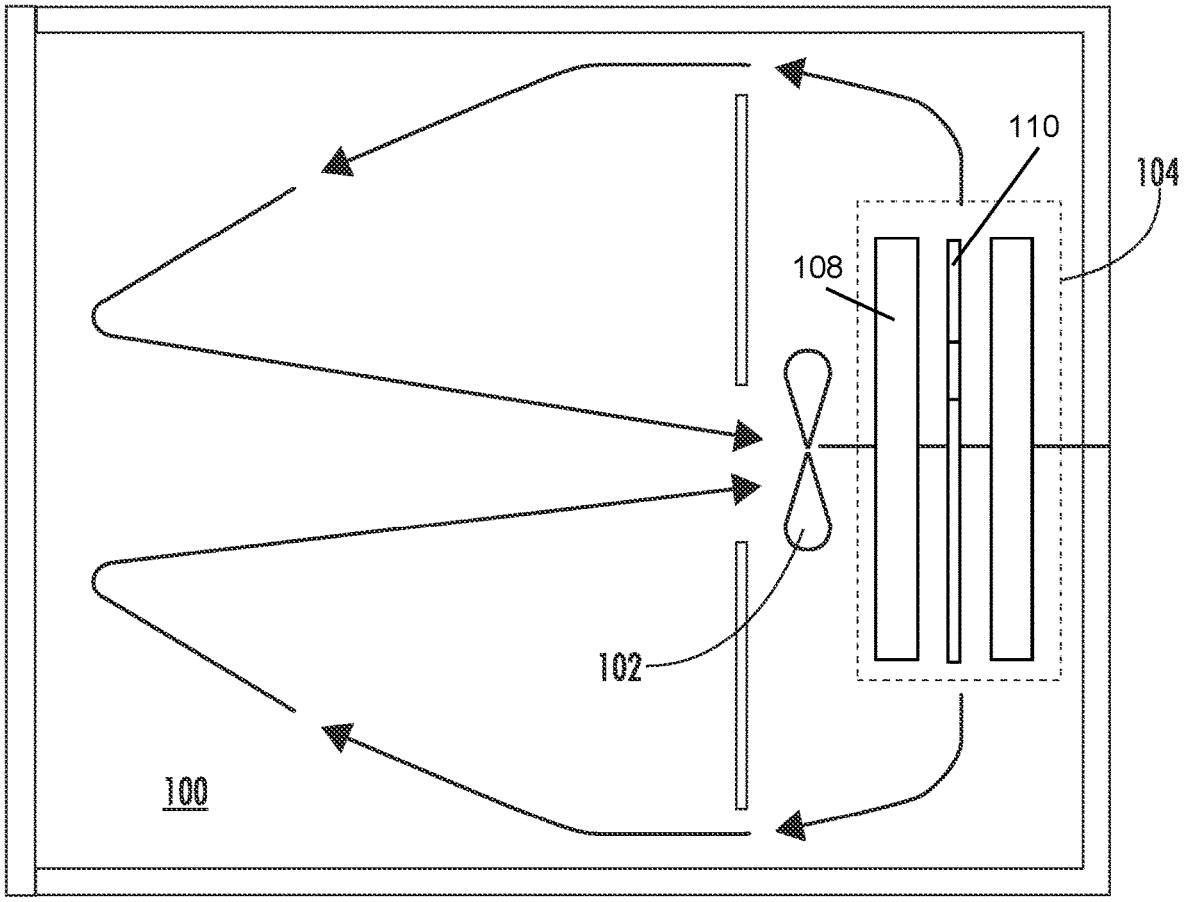
FIG. 2 is a diagram showing the airflow within the oven of FIG. 1.

FIG. 1 is a perspective view of an inner portion of the oven 100 (e.g., the oven 100 is shown in FIG. 2) showing the fan 102 and heating element 104. As show in in FIG. 2, the fan 102 pulls air from an oven cavity and pushes it over the heating element 104. The hot air is then pushed out back into the oven cavity and heats whatever is placed in the oven.

Figure 3:
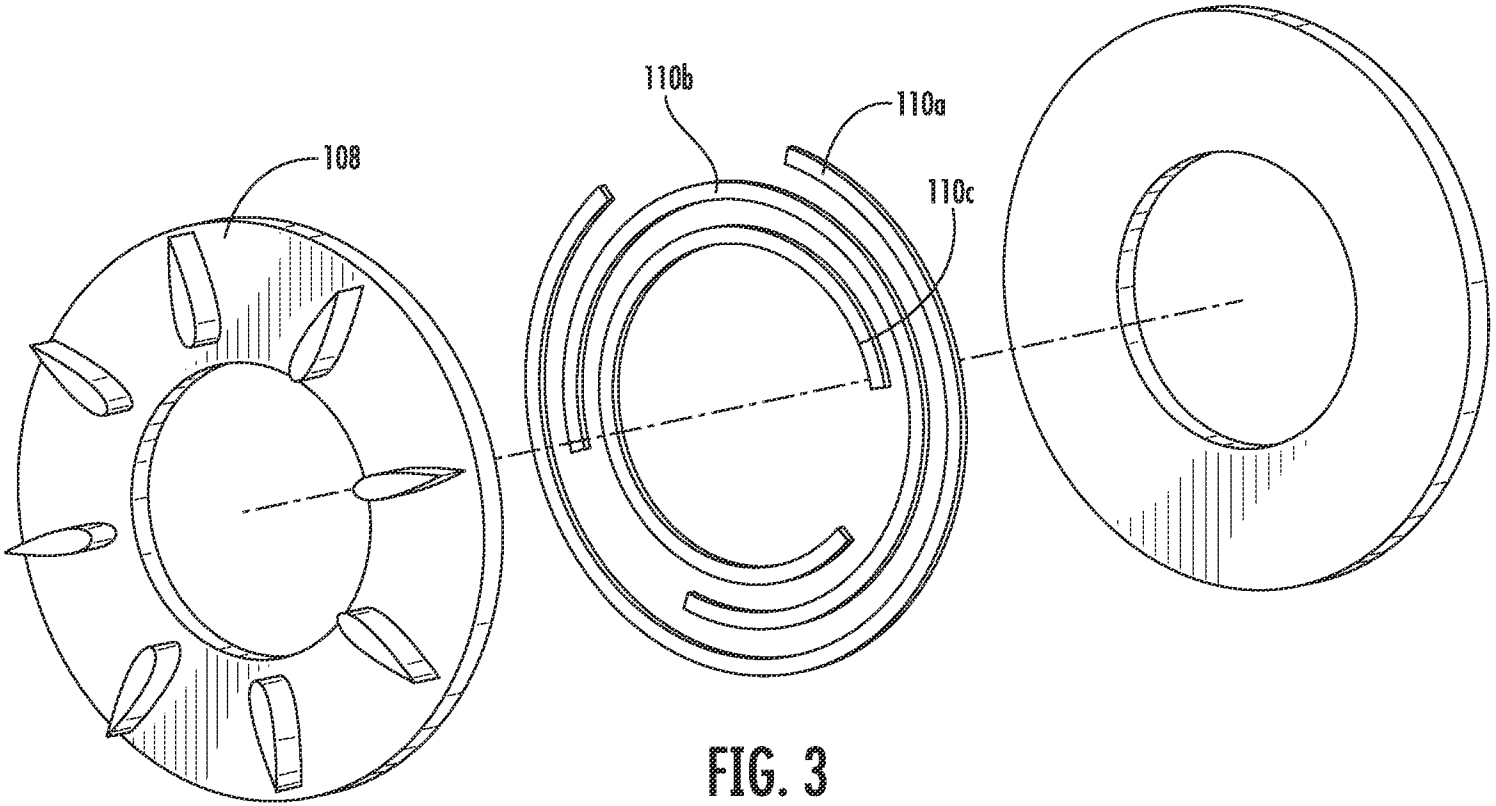
FIG. 3 is a perspective view of the heating element showing a fin arrangement.

FIG. 3 is a perspective view of the heating element 104. The heating element 104 includes in the shape of a disk, having an empty center, having an outer metallic layer 108 and a ceramic layer 110 (shown in FIG. 4) sandwiched within the metallic layer 108. The outer metallic layer 108 can include a fin or plurality of fins 111 radiating therefrom in order to increase the heat sink ability of the heating element and to direct the airflow in a particular direction in order to avoid cold spots within the oven. The fins 111 can radiate orthogonal to a plane defined by the metallic layer 108. The heating element 104 can be attached to the inner portion of the oven using one or a plurality of attachment points 112 for attaching the disk to an inner portion of the oven 100 (e.g., the oven 100 is shown in FIG. 2). The attachment points 112 can house a conductor to supply the electricity and heat to the heating element 104 or to simply keep the heating element 104 in place. Details is of the attachment points are shown in FIG. 5

Figures 4A, 4B, 4C:
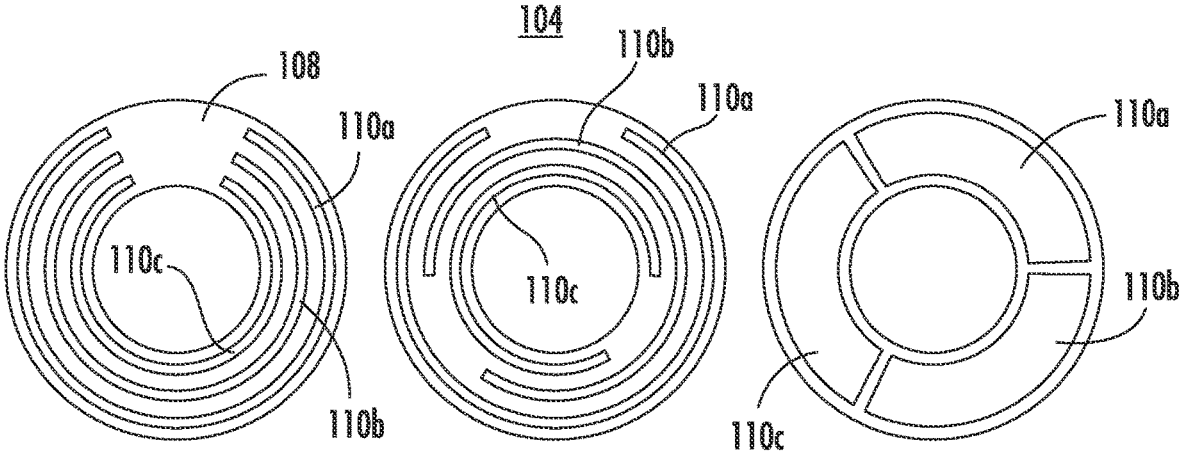
FIG. 4*a*-4*c* are front sectional views of the heating element showing the various possible arrangements of the ceramic sections.

FIG. 4*a*-4*c* are front sectional views of the heating element 104 showing the various possible arrangements of the ceramic sections 110 within the metallic layer 108. Each of the ceramic sections shown here include at least three distinct individual sections (a, b, c). Each of the section (a, b, c) are disconnected from each other. In FIG. 4*b*, the individual sections (a, b, c) cover every radial direction across 360 degrees emanating from the center of the heating element 104. The three distinct individual sections (a, b, c) partially overlap with each other allowing the emanating heat to be evenly dispersed and compensate for cold zones or avoid hot spots. Also in order to keep a balanced load, it is preferred that a plurality of segments (a, b, c) is a multiple of three.

Figure 5:
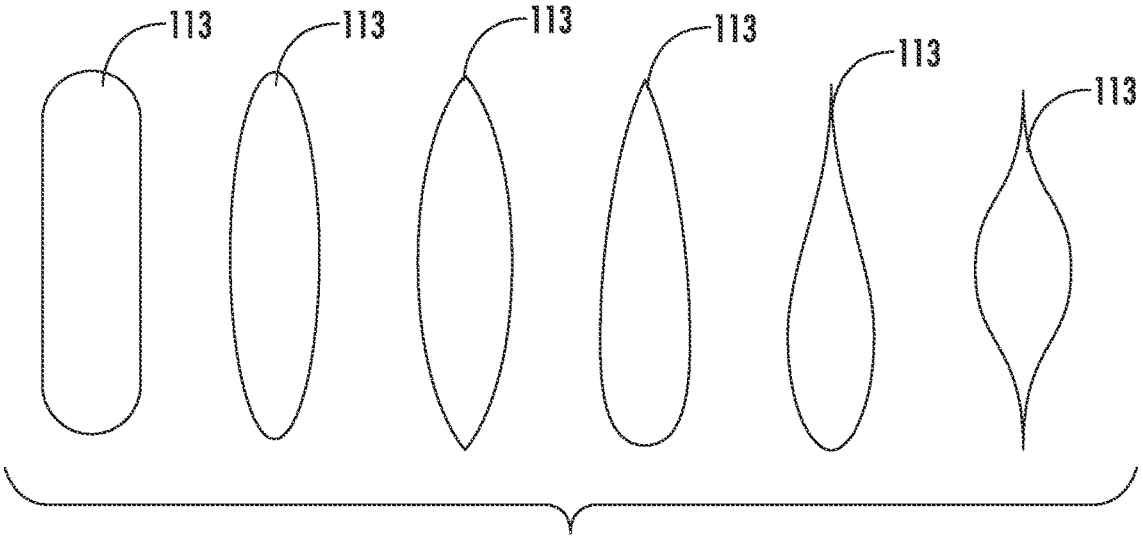
FIG. 5 are front views of the attachment points of FIG. 1

FIG. 5 is front views of the attachment points of FIG. 1. The attachment points 112 include at least one aerodynamic feature 113 which helps reduce noise and streamline the airflow within the oven. The aerodynamic features 113 can include rounded edges, teardrops, cylindrical, oval, elliptical shapes. The attachments points can also be used to supply the power.

The methods and systems of the present disclosure, as described above and shown in the drawings, provide for heating elements with superior properties including optimized airflow, decreased thickness, compensation for cold zones, lower recurring production costs, and simpler installation procedures. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. An oven heating element assembly comprising:

a heating element operable to heat air that flows across the heating element, wherein the heating element includes:

a disk having a first metallic layer, a ceramic layer sandwiched between the first metallic layer and a second metallic layer, and an empty center defined by a through hole that extends from the first metallic layer to the second metallic layer, wherein at least one of the metallic layers includes a fin radiating therefrom in a direction orthogonal to a plane defined by a primary surface of the at least one of the metallic layers; and a fan operable to cause air to flow across the heating element.

2. The assembly of claim 1, wherein the ceramic layer includes at least three distinct individual sections.

3. The assembly of claim 2, wherein each of the at least three distinct individual sections are disconnected from each other.

4. The assembly of claim 2, wherein the at least three distinct individual sections each extend less than 360 degrees about the center of the disk and are layered in a radial direction such that at least one of the at least three distinct individual sections covers each of the 360 degrees about the center of the of the disk.

5. The assembly of claim 4, wherein the at least three distinct individual sections partially overlap.

6. The assembly of claim 1, further comprising at least one attachment point for attaching the disk to an inner portion of the oven.

7. The assembly of claim 6, wherein the attachment point includes at least one aerodynamic feature, to reduce the impact on the airflow.

8. The assembly of claim 1, wherein the fan is configured to pull air from an oven cavity and push it over the heating element.

9. A heating element operable to heat air that flows across the heating element comprising:

a first metallic layer defined by a closed circular shape having a first empty center defining by a first through hole, the first metallic layer forming a front face of the heating element;

a second metallic layer a second empty center defining by a second through hole, the second metallic layer forming a back face of the heating element; and a ceramic layer, having a third empty center defining by a third through hole, disposed between the first metallic layer and the second metallic layer;

wherein at least one of the metallic layers includes a fin radiating therefrom in a direction orthogonal to a plane defined by a primary surface of the at least one of the metallic layers.

10. The heating element of claim 9, wherein the ceramic layer is thinner than either of the metallic layers.

11. The heating element of claim 9, wherein the ceramic layer is fully enclosed by the first metallic layer and the second metallic layer.

12. The heating element of claim 11, wherein the ceramic layer is flush against the first metallic layer.

13. The heating element of claim 11, wherein the ceramic layer is flush against the second metallic layer.

* * * * *